US010392210B2

(12) United States Patent
Kuo et al.

(10) Patent No.: US 10,392,210 B2
(45) Date of Patent: Aug. 27, 2019

(54) TRANSMISSION DEVICE

(71) Applicant: Foxlink Image Technology Co., Ltd., New Taipei (TW)

(72) Inventors: Ping Chi Kuo, New Taipei (TW); Pei Chun Lu, New Taipei (TW); Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 16/043,187

(22) Filed: Jul. 24, 2018

(65) Prior Publication Data

US 2019/0177100 A1 Jun. 13, 2019

(30) Foreign Application Priority Data

Dec. 13, 2017 (TW) ..... 106218458 U

(51) Int. Cl.

| | |
|---|---|
| ***B65H 3/06*** | (2006.01) |
| ***B65H 3/52*** | (2006.01) |
| ***B65H 5/06*** | (2006.01) |
| ***B65H 7/02*** | (2006.01) |
| ***B65H 7/18*** | (2006.01) |
| ***B65H 7/20*** | (2006.01) |
| ***B65H 9/00*** | (2006.01) |

(52) U.S. Cl.

CPC ..... *B65H 3/0669* (2013.01); *B65H 3/5246* (2013.01); *B65H 5/06* (2013.01); *B65H 7/02* (2013.01); *B65H 7/18* (2013.01); *B65H 7/20* (2013.01); *B65H 9/004* (2013.01); *B65H 9/006* (2013.01); *B65H 2403/20* (2013.01); *B65H 2403/70* (2013.01); *B65H 2403/724* (2013.01); *B65H 2403/80* (2013.01)

(58) Field of Classification Search

CPC ..... B65H 3/0669; B65H 5/06; B65H 5/062; B65H 7/00; B65H 7/02; B65H 7/14; B65H 7/18; B65H 7/20; B65H 9/004; B65H 9/006; B65H 29/14; B65H 2403/20; B65H 2403/70; B65H 2403/724; B65H 2403/80

See application file for complete search history.

(56) References Cited

U.S. PATENT DOCUMENTS

2002/0101025 A1* 8/2002 Lee ..... B65H 3/063 271/10.11
2017/0022018 A1* 1/2017 Koda ..... B65H 3/0669

* cited by examiner

*Primary Examiner* — Prasad V Gokhale
(74) *Attorney, Agent, or Firm* — Lin & Associates Intellectual Property, Inc.

(57) ABSTRACT

A transmission device includes a driving motor, a separation roller module, a correction roller module, a discharging roller module, a first clutch, a second clutch, a third clutch and a plurality of sensors which are mounted to an automatic sheet feeder. The first clutch is disposed between the driving motor and the separation roller module. The second clutch is disposed between the driving motor and the correction roller module. The third clutch is disposed between the driving motor and the discharging roller module. The plurality of the sensors sense signal variations at the time of a leading end or a tail end of each of the documents passing through the plurality of the sensors, and the plurality of the sensors transmit the signal variations to the first clutch, the second clutch and the third clutch.

11 Claims, 8 Drawing Sheets

TRANSMISSION DEVICE

CROSS-REFERENCE TO RELATED APPLICATION

The present application is based on, and claims priority form, Taiwan Patent Application No. 106218458, filed Dec. 13, 2017, the disclosure of which is hereby incorporated by reference herein in its entirety.

BACKGROUND OF THE INVENTION

1. Field of the Invention

The present invention generally relates to a transmission device, and more particularly to a transmission device assembled to an automatic sheet feeder.

2. The Related Art

With improvements of softwares and hardwares, a conventional scanner has become one of basic equipments of many computer users. The conventional scanner is capable of scanning and inputting character and image materials into a computer, and processing the character and image materials. The character and image materials include paper type documents, magazines, books, pictures and cards. The conventional scanner includes an automatic sheet feeder. The automatic sheet feeder includes a transmission device. The transmission device assembled to the automatic sheet feeder, includes a plurality of rollers, and a driving element for driving the plurality of the rollers. Generally, a motor is used as the driving element for driving the plurality of the rollers in design. If each of the plurality of the rollers needs controlling independently, two controlling ways are usually provided. One controlling way is to use a one-way clutch for achieving a purpose of controlling the plurality of the rollers. The other controlling way is to equip a new independent motor on the transmission device for achieving the purpose of controlling the plurality of the rollers. When the one-way clutch is used, the one-way clutch usually cooperates with a speed difference among the plurality of the rollers and a mechanism design of an idling angle to reach the purpose of controlling the plurality of the rollers. The mechanism design of the idling angle is capable of making the plurality of the rollers keep static statues in a short time. The idling angle is capable of returning to an original position by virtue of the one-way clutch cooperating with the speed difference among the plurality of the rollers.

However, though a cost of using the one-way clutch in design is lower and the transmission device occupies less space, limitations of the controlling way of the plurality of the rollers by use of the one-way clutch are more and an application elasticity of the controlling way of the plurality of the rollers by use of the one-way clutch is smaller. When the new independent motor is equipped on the transmission device, the new independent motor will usually collocate with a sensor, the new independent motor is controlled to work or stop working by use of switching on or switching off the sensor, through an application elasticity of the other controlling way of the plurality of the rollers is greater, a cost of using the new independent motor in design is higher and the transmission device needs more space to make the new independent motor have enough space to be able to be equipped on the transmission device. So the above-mentioned two controlling ways of the plurality of the rollers are both incapable of furthest realizing needs of the greater application elasticity, the lower cost and saving space.

In order to overcome the shortcomings described above, it is essential to improve the transmission device assembled to the automatic sheet feeder, so the transmission device is in urgent need of being modulated to design a new controlling way, and correspondingly an innovative transmission device assembled to an innovative automatic sheet feeder need be designed.

SUMMARY OF THE INVENTION

An object of the present invention is to provide a transmission device assembled to an automatic sheet feeder. The transmission device includes a driving motor mounted to the automatic sheet feeder, a separation roller module, a correction roller module, a discharging roller module, a first clutch, a second clutch, a third clutch and a plurality of sensors. The separation roller module is mounted to the automatic sheet feeder. The separation roller module includes a separation shaft, a separation roller mounted to one end of the separation shaft, and a separation gear mounted to the other end of the separation shaft. The correction roller module is mounted to the automatic sheet feeder. The correction roller module includes a correction shaft, and a correction roller mounted around the correction shaft. The discharging roller module is mounted to the automatic sheet feeder. The discharging roller module includes a discharging shaft, and a discharging roller mounted around the discharging shaft. The first clutch is disposed between the driving motor and the separation roller module. The first clutch is connected with the separation roller module and controls the separation roller module to rotate or stop rotating to control a distance between each two documents fed by the automatic sheet feeder. The second clutch is disposed between the driving motor and the correction roller module. The second clutch is connected with the correction roller module and controls the correction roller module to rotate or stop rotating to correct a skew of each of the documents. The third clutch is disposed between the driving motor and the discharging roller module. The third clutch is connected with the discharging roller module and controls the discharging roller module to rotate or stop rotating to improve a stacked condition of the documents at the time of the documents being discharged. The plurality of the sensors are mounted to the automatic sheet feeder. The plurality of the sensors sense signal variations at the time of a leading end or a tail end of each of the documents passing through the plurality of the sensors, and the plurality of the sensors transmit the signal variations to the first clutch, the second clutch and the third clutch so as to control the separation roller module, the correction roller module and the discharging roller module to rotate or stop rotating.

As described above, the first clutch is disposed between the driving motor and the separation roller module, the first clutch of the transmission device is connected with the separation roller module, and controls the separation roller module to rotate or stop rotating to control the distance between each two documents, the second clutch is disposed between the driving motor and the correction roller module, the second clutch is connected with the correction roller module, and controls the correction roller module to rotate or stop rotating to correct the skew of each of the documents, the third clutch is disposed between the driving motor and the discharging roller module, the third clutch is connected with the discharging roller module, and controls the discharging roller module to rotate or stop rotating to improve the stacked condition of the documents at the time of the documents being discharged, so that the transmission device assembled to the automatic sheet feeder has an above-mentioned controlling way, the above-mentioned controlling way of the transmission device is capable of realizing needs of a greater application elasticity, a lower cost and saving space.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
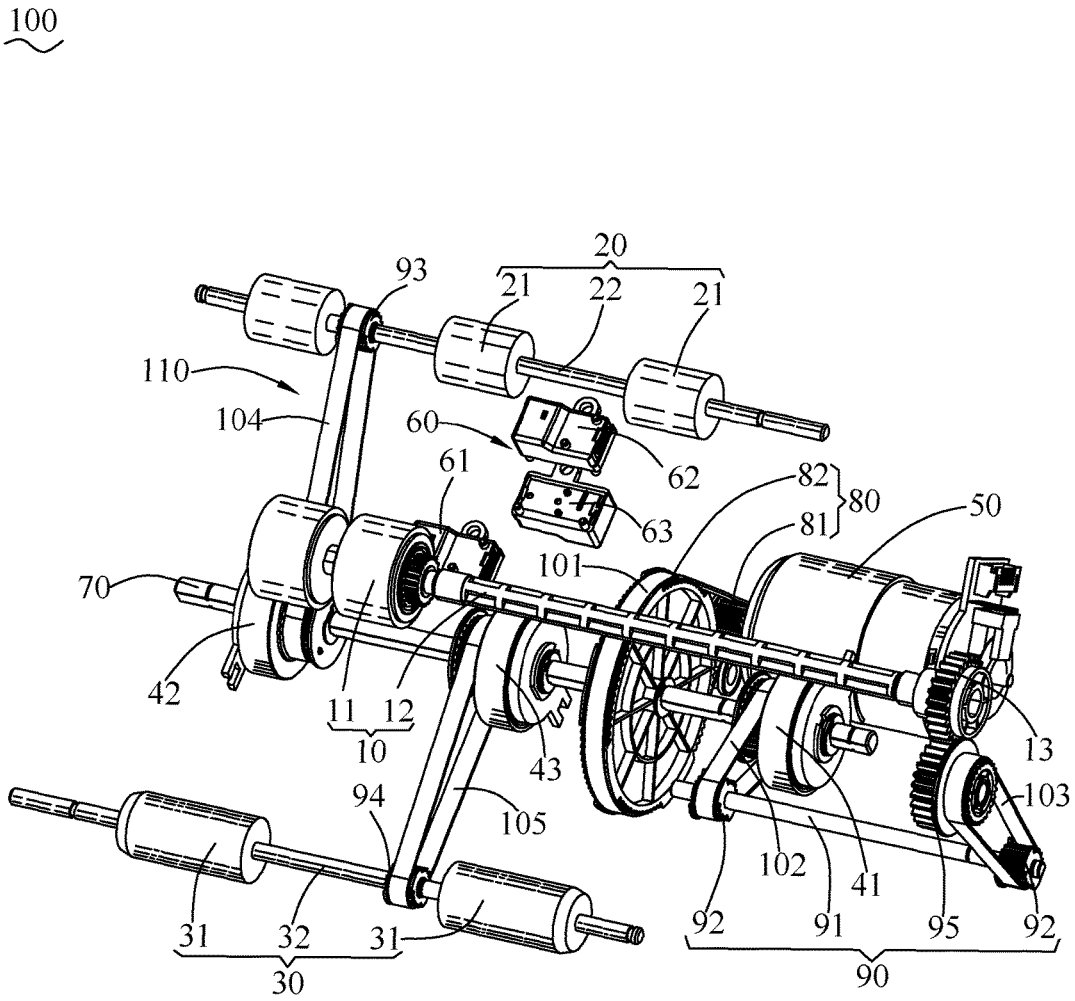
FIG. 1 is a perspective view of a transmission device in accordance with a preferred embodiment of the present invention.
Figure 2:
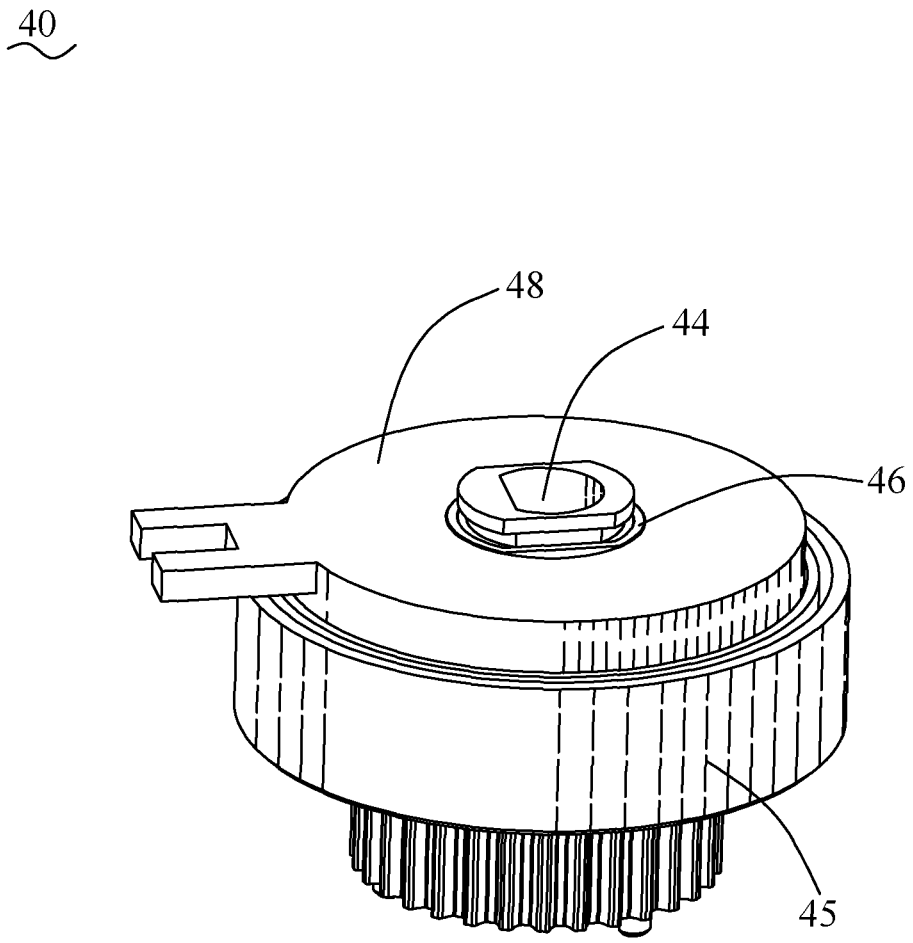
FIG. 2 is a perspective view of a clutch of the transmission device of FIG. 1.
Figure 3:
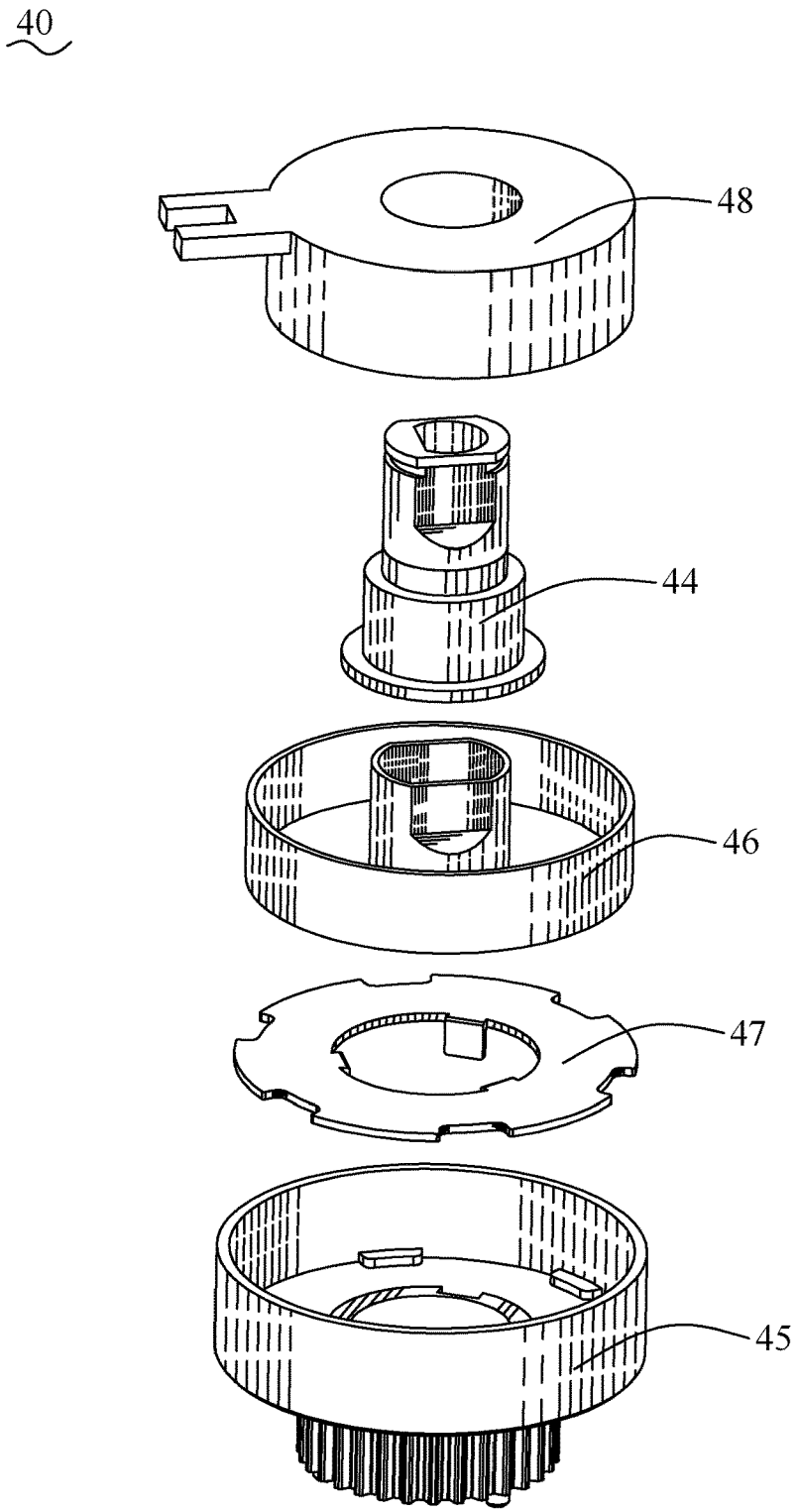
FIG. 3 is an exploded view of the clutch of the transmission device of FIG. 2.

With reference to FIG. 1, FIG. 2 FIG. 3, FIG. 4 and FIG. 8, a transmission device 100 in accordance with a preferred embodiment of the present invention is shown. The transmission device 100 is assembled to an automatic sheet feeder 200. The automatic sheet feeder 200 has functions of scanning documents 300. The documents 300 are paper type documents or card type documents. The transmission device 100 includes a separation roller module 10, a correction roller module 20, a discharging roller module 30, a plurality of clutches 40, a driving motor 50 for driving the plurality of the clutches 40, and a plurality of sensors 60. The separation roller module 10, the correction roller module 20, the discharging roller module 30, the plurality of the clutches 40, the driving motor 50 and the plurality of the sensors 60 are mounted to the automatic sheet feeder 200. In the preferred embodiment, when the driving motor 50 of the transmission device 100 is seen in FIG. 1 along a right-to-left direction, a clockwise rotation direction of the driving motor 50 is defined as a forward rotation direction.

Figure 4:
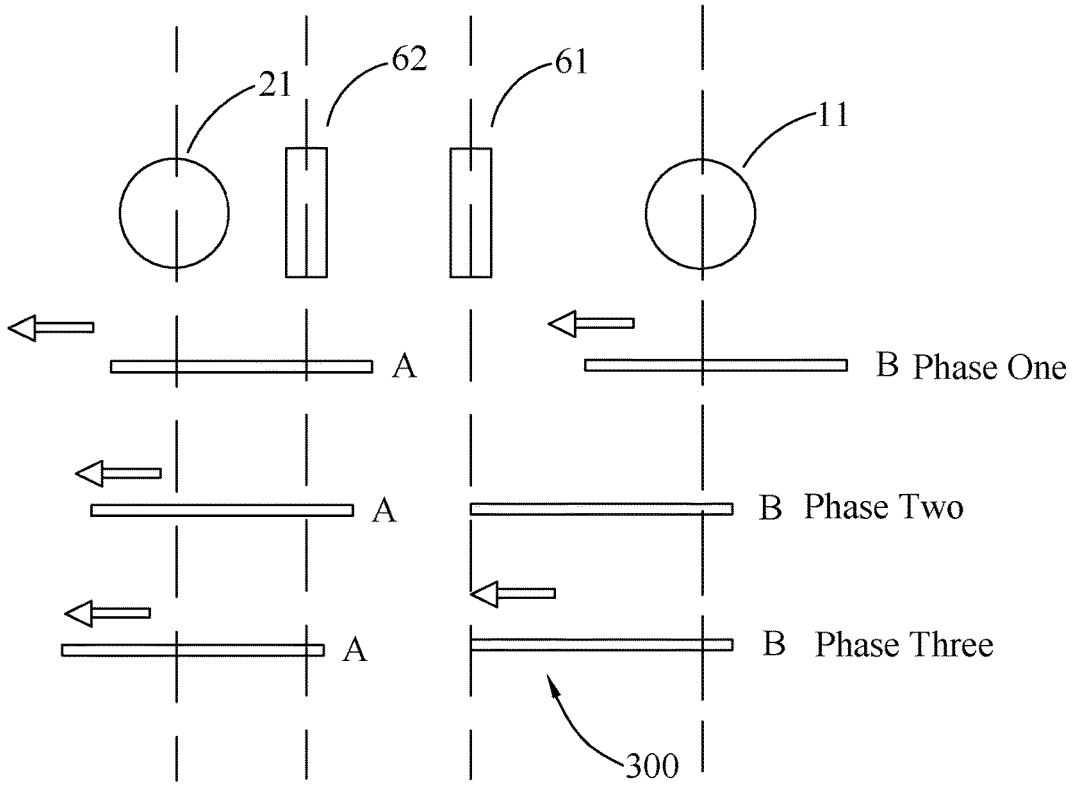
FIG. 4 is a diagrammatic drawing showing that a first clutch of the transmission device controls a separation roller of the transmission device in accordance with the present invention.
Figure 8:
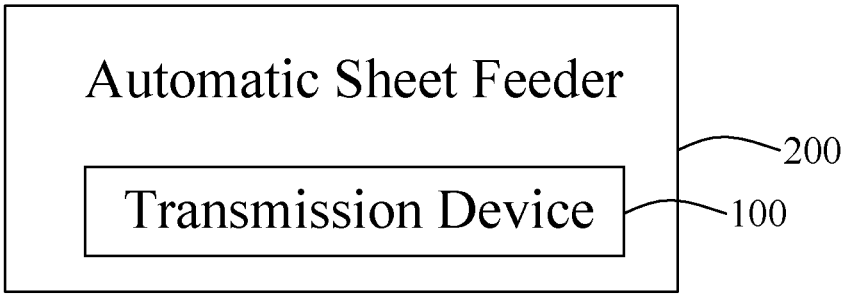
FIG. 8 is a block diagram of an automatic sheet feeder in accordance with the present invention, wherein the transmission device is assembled to the automatic sheet feeder.

With reference to FIG. 1, FIG. 4 and FIG. 8, the separation roller module 10 is mounted to the automatic sheet feeder 200. The separation roller module 10 is used for grabbing the documents 300 and further feeding the documents 300 into the automatic sheet feeder 200 one by one. The separation roller module 10 includes a separation shaft 12, a separation roller 11 mounted to one end of the separation shaft 12, and a separation gear 13 mounted to the other end of the separation shaft 12.

The correction roller module 20 is mounted to the automatic sheet feeder 200. The correction roller module 20 includes a correction shaft 22, and a correction roller 21 mounted around the correction shaft 22. In the preferred embodiment, the correction roller module 20 includes a plurality of the correction rollers 21. The plurality of the correction rollers 21 are mounted around the correction shaft 22.

The discharging roller module 30 is assembled to the automatic sheet feeder 200. The discharging roller module 30 includes a discharging shaft 32, and a discharging roller 31 mounted around the discharging shaft 32. In the preferred embodiment, the discharging roller module 30 includes two discharging rollers 31. The two discharging rollers 31 are mounted around two sides of the discharging shaft 32.

With reference to FIG. 1, FIG. 2, FIG. 3, FIG. 4 and FIG. 8, the plurality of the clutches 40 include a first clutch 41, a second clutch 42 and a third clutch 43. The first clutch 41 is disposed between the driving motor 50 and the separation roller module 10. The first clutch 41 is connected with the separation roller module 10 and controls the separation roller module 10 to rotate or stop rotating to control a distance between each two documents 300 fed by the automatic sheet feeder 200. The second clutch 42 is disposed between the driving motor 50 and the correction roller module 20. The second clutch 42 is connected with the correction roller module 20 and controls the correction roller module 20 to rotate or stop rotating to correct a skew of each of the documents 300. The third clutch 43 is disposed between the driving motor 50 and the discharging roller module 30. The third clutch 43 is connected with the discharging roller module 30 and controls the discharging roller module 30 to rotate or stop rotating to improve a stacked condition of the documents 300 at the time of the documents 300 being discharged.

In the preferred embodiment, each of the plurality of the clutches 40 is an electromagnetic type clutch. Each of the first clutch 41, the second clutch 42 and the third clutch 43 is the electromagnetic type clutch. When the plurality of the clutches 40 are in engagement statuses, the separation roller 11, the correction roller 21 and the discharging roller 31 rotate; when the plurality of the clutches 40 are in loosened statuses, the separation roller 11, the correction roller 21 and the discharging roller 31 stop rotating. The transmission device 100 further includes a fastening shaft 70, a driving gear module 80, a transmission gear module 90 and a plurality of transmission belts 110. The first clutch 41, the second clutch 42 and the third clutch 43 are mounted to and fastened to the fastening shaft 70. The plurality of the transmission belts 110 include a first transmission belt 101, a second transmission belt 102, a third transmission belt 103, a fourth transmission belt 104 and a fifth transmission belt 105.

Specifically, each of the plurality of the clutches 40 includes a driving element 44, a driven component 45, a first attracting element 46 fastened to and sleeved around the driving element 44, a second attracting element 47 mounted to and fastened to the driven component 45, and a hollow sleeving component 48. Each of the first clutch 41, the second clutch 42 and the third clutch 43 includes the driving element 44, the driven component 45, the first attracting element 46 fastened to and sleeved around the driving element 44, the second attracting element 47 mounted to and fastened to the driven component 45, and the hollow sleeving component 48. The driving element 44 is of a hollow shape. The driven component 45 is of a hollow shape. The first attracting element 46 is of a hollow shape. The second attracting element 47 is of a ring shape. The driving element 44 is mounted around and fastened to the fastening shaft 70. The driven component 45 is sleeved around a lower portion of the driving element 44. The sleeving component 48 is sleeved around an upper portion of the driving element 44. When each of the first clutch 41, the second clutch 42 and the third clutch 43 is in the engagement status, the first attracting element 46 and the second attracting element 47 are in a combination status due to an effect of a magnetic field of currents, the fastening shaft 70 drives the driving element 44 to rotate so as to drive the driven component 45 to rotate together with the fastening shaft 70 and the driving element 44. When each of the first clutch 41, the second clutch 42 and the third clutch 43 is in the loosened statuses, the first attracting element 46 and the second attracting element 47 are in a separated status due to the effect of the magnetic field of currents, the driving element 44 and the fastening shaft 70 rotate together, and the driven component 45 stops rotating. In the preferred embodiment, the driven component 45 is a pulley.

The driving gear module 80 includes a first driving gear 81 and a second driving gear 82. The first driving gear 81 is mounted to and fastened to one end of the driving motor 50. The second driving gear 82 is mounted to and fastened to the fastening shaft 70. The first transmission belt 101 is looped around the first driving gear 81 and the second driving gear 82, so the first driving gear 81 and the second driving gear 82 are connected by the first transmission belt 101.

The transmission gear module 90 includes a transmission gear shaft 91, two first transmission gears 92, a second transmission gear 93, a third transmission gear 94 and a fourth transmission gear 95. The two first transmission gears 92 are mounted to and fastened to two opposite ends of the transmission gear shaft 91. The second transmission gear 93 is mounted to and fastened to the correction shaft 22. The third transmission gear 94 is mounted to and fastened to the discharging shaft 32. Specifically, the second transmission belt 102 is looped around the driven component 45 of the first clutch 41 and one of the two first transmission gears 92, so the driven component 45 of the first clutch 41 is connected with and drives the one of the two first transmission gears 92 by the second transmission belt 102. The third transmission belt 103 is looped around the fourth transmission gear 95 and the other first transmission gear 92, so the other first transmission gear 92 is connected with and drives the fourth transmission gear 95 by the third transmission belt 103. The fourth transmission gear 95 is engaged with the separation gear 13. So the fastening shaft 70 drives the separation roller 11 of the separation roller module 10 to rotate by virtue of the transmission gear shaft 91, the two first transmission gears 92 and the fourth transmission gear 95 of the transmission gear module 90, the second transmission belt 102, the third transmission belt 103 and the separation gear 13.

The fourth transmission belt 104 is looped around the driven component 45 of the second clutch 42 and the second transmission gear 93. The driven component 45 of the second clutch 42 is connected with and drives the second transmission gear 93 by the fourth transmission belt 104.

The fifth transmission belt 105 is looped around the driven component 45 of the third clutch 43 and the third transmission gear 94. The driven component 45 of the third clutch 43 is connected with and drives the third transmission gear 94 by the fifth transmission belt 105. So the third clutch 43 drives the discharging roller 31 to rotate by virtue of the discharging shaft 32, the third transmission gear 94 and the fifth transmission belt 105.

The plurality of the sensors 60 are mounted to and fastened to the automatic sheet feeder 200. The plurality of the sensors 60 include a first sensor 61, a second sensor 62 and a third sensor 63. The plurality of the sensors 60 sense signal variations at the time of a leading end or a tail end of each of the documents 300 passing through the plurality of the sensors 60, and the plurality of the sensors 60 transmit the signal variations to the first clutch 41, the second clutch 42 and the third clutch 43 of the plurality of the clutches 40 so as to control the separation roller module 10, the correction roller module 20 and the discharging roller module 30 to rotate or stop rotating.

With reference to FIG. 1, FIG. 4 and FIG. 8, when the transmission device 100 is in work, after a previous document A enters the automatic sheet feeder 200, the driving motor 50 rotates in the forward rotation direction to drive the fastening shaft 70 to rotate by virtue of the driving gear module 80, at the moment, the first clutch 41 is in an engagement status, the fastening shaft 70 drives the separation roller module 10 to rotate so as to drive a subsequent document B following the previous document A to enter the automatic sheet feeder 200 (shown in phase one of FIG. 4). After the first sensor 61 detects a leading end of the subsequent document B, the first clutch 41 is loosened, the separation shaft 12 of the separation roller module 10 stops rotating to be incapable of bringing along the subsequent document B, the subsequent document B stops being fed forward (shown in phase two of FIG. 4). After passing through a first set period of delay time, a distance between the subsequent document B and the previous document A is increased, the first clutch 41 is in the engagement status again, and then the subsequent document B is driven to be fed forward again (shown in phase three of FIG. 4), so that the distance between each two documents 300 is completed being controlled.

Figure 5:
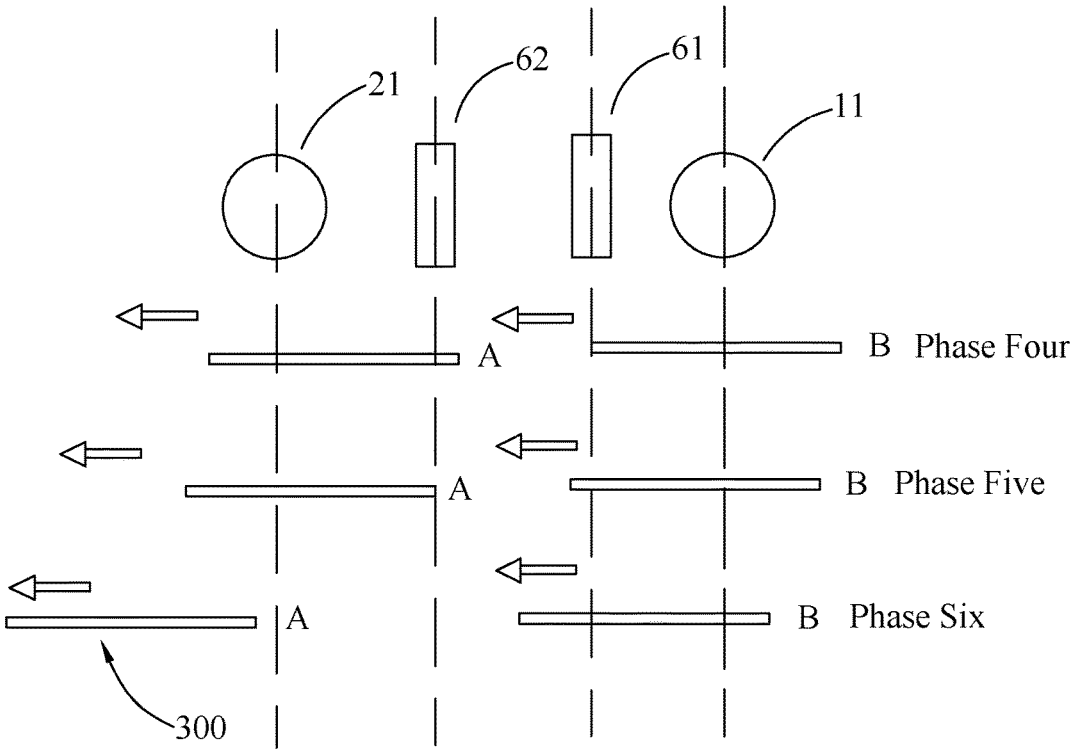
FIG. 5 is a diagrammatic drawing showing that a second clutch of the transmission device controls a correction roller of the transmission device in accordance with the present invention.

With reference to FIG. 1, FIG. 5, FIG. 6 and FIG. 8, at the moment, the second clutch 42 is in an engagement status, the fastening shaft 70 rotates in the forward rotation direction to drive the second clutch 42 to bring along the second transmission gear 93 so as to drive the correction roller 21 to rotate in the forward rotation direction, so that the previous document A is fed forward (shown in phase four of FIG. 5). After the second sensor 62 detects a tail end of the previous document A (shown in phase five of FIG. 5), the previous document A continues being fed forward. After a second set period of delay time is passed and the tail end of the previous document A leaves the correction roller 21, the second clutch 42 is loosened, the correction shaft 22 stops rotating (shown in phase six of FIG. 5). At the moment, the first clutch 41 is in the engagement status, the driving motor 50 drives the fastening shaft 70 to drive the separation roller 11 to rotate so as to drive the subsequent document B to be fed forward, after the second sensor 62 detects the leading end of the subsequent document B (shown in phase seven of FIG. 6), until the leading end of the subsequent document B reaches the correction roller 21 to complete an action of correcting a skew of the subsequent document B (shown in phase eight of FIG. 6). After passing through a third set period of delay time, the second clutch 42 is in the engagement status again to drive the correction roller 21 so as to drive the subsequent document B to be continued being fed forward (shown in phase nine of FIG. 6), in that case, an effect of correcting the skew of each of the documents 300 is achieved.

Figure 7:
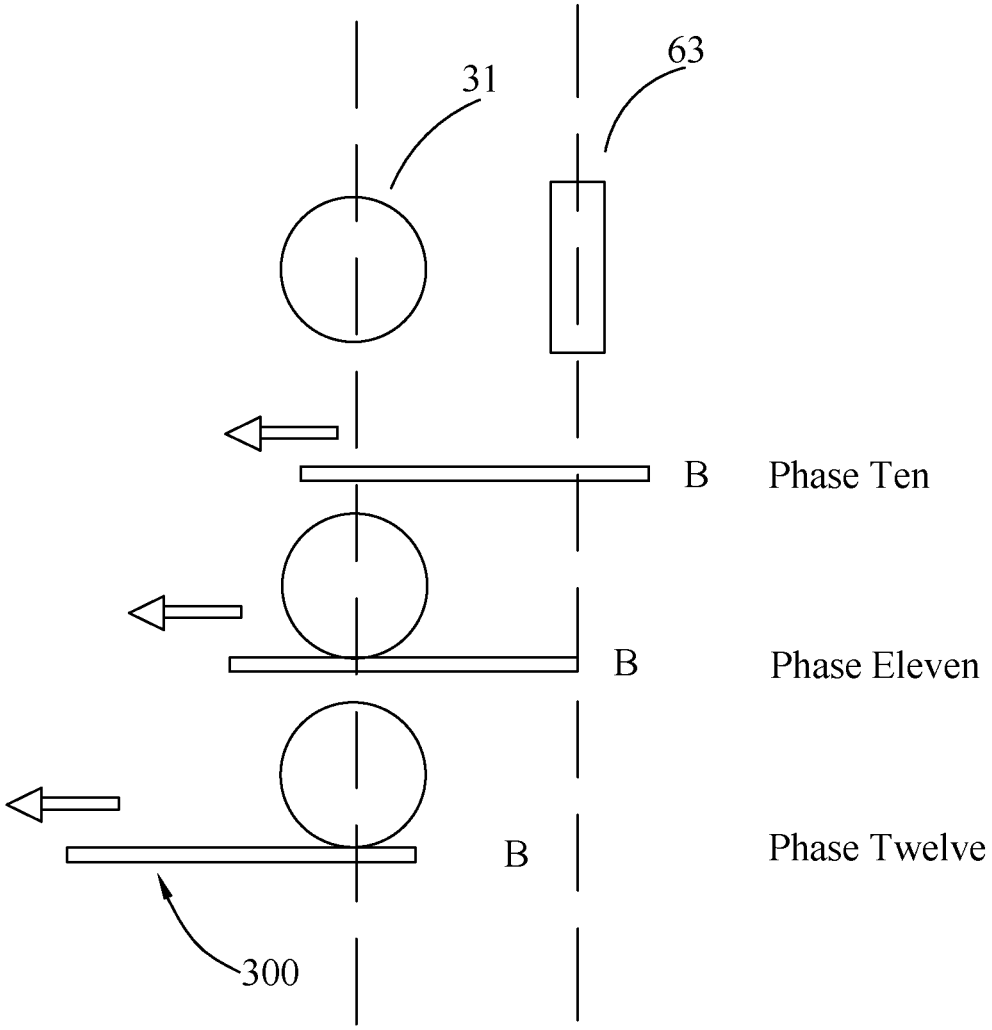
FIG. 7 is a diagrammatic drawing showing that a third clutch of the transmission device controls a discharging roller of the transmission device in accordance with the present invention.

With reference to FIG. 1, FIG. 7 and FIG. 8, when the subsequent document B achieves to the discharging roller 31 (shown in phase ten of FIG. 7), the third clutch 43 is in an engagement status, the third clutch 43 drives the discharging roller 31 to rotate so as to drive the subsequent document B to be fed forward, after the third sensor 63 detects a tail end of the subsequent document B (shown in phase eleven of FIG. 7), a fourth set period of delay time is passed, the tail end of the subsequent document B approaches to the discharging roller 31. When the tail end of the subsequent document B approaches to the discharging roller 31, the third clutch 43 is loosened, the discharging roller 31 stops rotating, at the moment, the subsequent document B will be continued being fed forward on account of an inertia of the subsequent document B, but a speed of the subsequent document B will be slowed, a fifth set period of delay time is passed, and then the third clutch 43 is in the engagement status, the discharging roller 31 rotates again so as to drive the subsequent document B to complete a paper discharged action (shown in phase twelve of FIG. 7). In this way, a stopping and immediately restarting action of the discharging roller 31 is controlled by use of the third clutch 43 to lower a speed of each of the documents 300 being discharged so as to improve the stacked condition of the documents 300.

Figure 6:
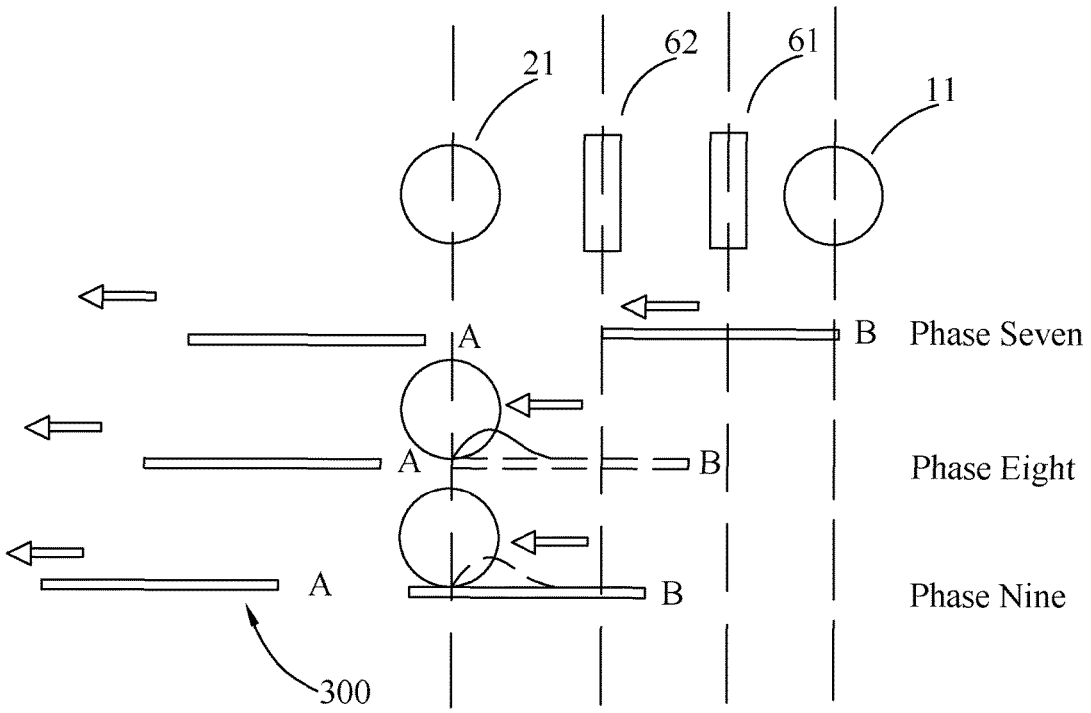
FIG. 6 is another diagrammatic drawing showing that the second clutch of the transmission device controls the correction roller of the transmission device in accordance with the present invention.

With reference to FIG. 6, preferably, the previous document A and the subsequent document B are the paper type documents.

As described above, the first clutch 41 is disposed between the driving motor 50 and the separation roller module 10, the first clutch 41 of the transmission device 100 is connected with the separation roller module 10, and controls the separation roller module 10 to rotate or stop rotating to control the distance between each two documents 300, the second clutch 42 is disposed between the driving motor 50 and the correction roller module 20, the second clutch 42 is connected with the correction roller module 20, and controls the correction roller module 20 to rotate or stop rotating to correct the skew of each of the documents 300, the third clutch 43 is disposed between the driving motor 50 and the discharging roller module 30, the third clutch 43 is connected with the discharging roller module 30, and controls the discharging roller module 30 to rotate or stop rotating to improve the stacked condition of the documents 300 at the time of the documents 300 being discharged, so that the transmission device 100 assembled to the automatic sheet feeder 200 has an above-mentioned controlling way, the above-mentioned controlling way of the transmission device 100 is capable of realizing needs of a greater application elasticity, a lower cost and saving space.

What is claimed is:

1. A transmission device assembled to an automatic sheet feeder, comprising:

a driving motor mounted to the automatic sheet feeder;

a separation roller module mounted to the automatic sheet feeder, the separation roller module including a separation shaft, a separation roller mounted to one end of the separation shaft, and a separation gear mounted to the other end of the separation shaft;

a correction roller module mounted to the automatic sheet feeder, the correction roller module including a correction shaft, and a correction roller mounted around the correction shaft;

a discharging roller module mounted to the automatic sheet feeder, the discharging roller module including a discharging shaft, and a discharging roller mounted around the discharging shaft;

a first clutch disposed between the driving motor and the separation roller module, the first clutch being connected with the separation roller module and controlling the separation roller module to rotate or stop rotating to control a distance between each two documents fed by the automatic sheet feeder;

a second clutch disposed between the driving motor and the correction roller module, the second clutch being connected with the correction roller module and controlling the correction roller module to rotate or stop rotating to correct a skew of each of the documents;

a third clutch being disposed between the driving motor and the discharging roller module, the third clutch being connected with the discharging roller module and controlling the discharging roller module to rotate or stop rotating to improve a stacked condition of the documents at the time of the documents being discharged;

a plurality of sensors mounted to the automatic sheet feeder, the plurality of the sensors sensing signal variations at the time of a leading end or a tail end of each of the documents passing through the plurality of the sensors, and the plurality of the sensors transmitting the signal variations to the first clutch, the second clutch and the third clutch so as to control the separation roller module, the correction roller module and the discharging roller module to rotate or stop rotating; and a fastening shaft, the first clutch, the second clutch and the third clutch being fastened to the fastening shaft.

2. The transmission device as claimed in claim 1, further comprising a driving gear module and a plurality of transmission belts, the driving gear module including a first driving gear and a second driving gear, the plurality of the transmission belts including a first transmission belt, the first driving gear being fastened to one end of the driving motor, the second driving gear being fastened to the fastening shaft, the first transmission belt being looped around the first driving gear and the second driving gear, so the first driving gear and the second driving gear being connected by the first transmission belt.

3. The transmission device as claimed in claim 1, wherein each of the first clutch, the second clutch and the third clutch includes a driving element, a driven component, a first attracting element sleeved around the driving element, and a second attracting element fastened to the driven component, the driving element is fastened to the fastening shaft, the driven component is sleeved around the driving element, when each of the first clutch, the second clutch and the third clutch is in an engagement status, the first attracting element and the second attracting element are in a combination status due to an effect of a magnetic field of currents, the fastening shaft drives the driving element to rotate so as to drive the driven component to rotate together with the fastening shaft and the driving element, when each of the first clutch, the second clutch and the third clutch is in a loosened status, the first attracting element and the second attracting element are in a separated status due to the effect of the magnetic field of currents, the driving element and the fastening shaft rotate together, and the driven component stops rotating.

4. The transmission device as claimed in claim 3, wherein the driven component is a pulley.

5. The transmission device as claimed in claim 3, wherein the driving element is of a hollow shape.

6. The transmission device as claimed in claim 3, wherein the driven component is of a hollow shape.

7. The transmission device as claimed in claim 3, wherein the first attracting element is of a hollow shape.

8. The transmission device as claimed in claim 3, wherein the second attracting element is of a ring shape.

9. The transmission device as claimed in claim 3, further comprising a transmission gear module which includes a transmission gear shaft, two first transmission gears, a second transmission gear, a third transmission gear and a fourth transmission gear, the two first transmission gears being fastened to two opposite ends of the transmission gear shaft, the second transmission gear being fastened to the correction shaft, the third transmission gear being fastened to the discharging shaft.

10. The transmission device as claimed in claim 9, further comprising a plurality of transmission belts which include a second transmission belt, a third transmission belt, a fourth transmission belt and a fifth transmission belt, the second transmission belt being looped around the driven component of the first clutch and one of the two first transmission gears, so the driven component of the first clutch being connected with and driving the one of the two first transmission gears by the second transmission belt, the third transmission belt being looped around the fourth transmission gear and the other first transmission gear, so the other first transmission gear being connected with and driving the fourth transmission gear by the third transmission belt, the fourth transmission gear being engaged with the separation gear.

11. The transmission device as claimed in claim 1, wherein each of the first clutch, the second clutch and the third clutch is an electromagnetic type clutch.

* * * * *